United States Patent [19]

Toto

[11] 4,192,498

[45] Mar. 11, 1980

[54] SHEET SEPARATING AND FEEDING APPARATUS

[75] Inventor: John A. Toto, Milford, Conn.

[73] Assignee: Pitney-Bowes, Inc., Stamford, Conn.

[21] Appl. No.: 947,532

[22] Filed: Oct. 2, 1978

[51] Int. Cl.[2] ..... B65H 3/30

[52] U.S. Cl. ..... 271/21

[58] Field of Search ..... 271/16, 17, 19–25

[56] References Cited

U.S. PATENT DOCUMENTS 3,476,381 11/1969 Carlson ..... 271/21 UX 3,684,276 8/1972 Bridgeman ..... 271/20

FOREIGN PATENT DOCUMENTS 943591 5/1956 Fed. Rep. of Germany ..... 271/21

*Primary Examiner*—Richard A. Schacher

*Attorney, Agent, or Firm*—Martin D. Wittstein; William D. Soltow, Jr.; Albert W. Scribner

[57] ABSTRACT

A two-stage sheet separating apparatus has a pair of corner separators and a top feed roller for initially separating a top sheet from a stack of sheets. A pair of retarding blades, one for each corner separator, are disposed downstream from the separators for finally separating the top sheet from any lower sheets which may have been carried along by inter-sheet frictional forces. The lower corners of the stack of sheets are supported by wedges in order to increase the beam strength of the sheets and thereby reduce the incidences where more than one sheet at a time is fed from the stack.

8 Claims, 7 Drawing Figures

SHEET SEPARATING AND FEEDING APPARATUS

BACKGROUND OF THE INVENTION

1. Field of the Invention

This invention relates to an article of manufacture and an apparatus for feeding sheets from stacks of sheets and, in particular, to separating an article and apparatus for separating the top sheet from the rest of the sheets in order to feed one sheet at a time.

2. Prior Art

In most printing, duplicating and copying machines there is an apparatus for feeding copy sheets from a stored, stack of sheets into the machine for further processing. In order to properly perform its functions, a sheet feeder should feed only one sheet at a time. A recurrent problem with such sheet feeders in the feeding of two or more sheets at a time, either together or overlapping one another. Such multifeeding of sheets can be minimized by using a vacuum sheet feeder apparatus which uses a vacuum means to separate the top sheet from a stack of sheets. A belt conveyor or other suitable means is used to carry the top, separated sheet away from the stack. Although such vacuum feeders are highly reliable, they are also expensive, bulky, noisey, and thus ill-suited for a copying machine that is to be used in an office environment.

A simpler, smaller, and less expensive apparatus is a friction sheet feeder in which a suitable sheet advancing means, such as an intermittently driven feed roller, frictionally engages the top sheet to feed it from the stack. The top sheet is separated by any suitable separator means, such as a pair of corner separators disposed at opposed corners of the stack. In operation, the leading edge of the top sheet is slightly deformed or buckled against the corner separator under the influence of the friction feed rollers. Since the frictional feeding force is always set to be greater than the sheet-to-sheet drag, the top sheet ultimately is separated and advanced from the stack. However, a common and repeated problem is that one or more sheets are carried along with the top sheet.

Such a problem is commonly referred to as a multifeed and can occur at any time. It is believed to be caused by inter-sheet frictional forces that are influenced by such ambient factors as temperature, humidity, the normal force of the feed roller, as well as by inherent factors, such as the sheet finish, the type and grade of sheet, and the mechanical properties of the sheet, e.g. beam strength. Some have tried to solve the problem of multifeeds by controlling the environment of sheet feeder to minimize the effects of the ambient factors. Accordingly, sheet feeders have been equipped with temperature, humidity and other environmental controls. Others have designed special sheet feeders which can properly handle only a specific type or types of sheets. It is also believed that multifeeding may be caused, at least in part, by minute mechanical interlocking or hooking of the frayed edges of a stack of sheets. Such fraying can result from the manufacture of the paper when dull knives are used to cut the paper into standard size sheets. To remedy that problem it has been proposed to prop up the center of a stack of sheets, disposing the stack convexly, with respect to the friction feeder, in order to separate or fan out the edges of the stack. Still others have devised various sheet separators which are said to improve the performance of the feeders. See for example, U.S. Pat. Nos. 3,601,389 and 3,574,348. In spite of such attempts, the problem of multifeeds persists and there remains a long felt, unsatisfied need for a reliable friction sheet feeder.

It is an object of this invention to provide a reliable sheet feeder.

It is also an object to provide a sheet feeder that minimizes the occurrence of multifeeds. A further object is to provide a two stage sheet separator using a first stage pair of corner separators and a second stage pair of retarding blades to inhibit the advance of all but the top sheet.

An object is to provide a retarding blade transverse to a predetermined path of the leading edge of the top sheet and having a groove for receiving the leading edges of sheets advanced along said predetermined path.

A further object is to provide an apparatus for optimizing the beam strength of a stack of sheets in order to assist the separation of the top sheet therefrom.

It is also an object to provide a means for concavely disposing a stack of sheets with respect to a friction sheet feeding means.

An added object is to provide a pair of triangular wedges one in each opposed corner along the bottom of the leading edge of a stack of sheets in order to concavely dispose the stack of sheets and thereby increase the beam strength thereof.

The foregoing as well as other objects and advantages will be understood from the following summary and detailed description, the accompanying drawings and the appended claims.

SUMMARY

In its fundamental form, the invention is an article of manufacture and an apparatus designed to separate a top, frictionally driven sheet from one or more lower sheets that are frictionally dragged along with the top sheet. The invention comprises a retarding blade adapted to be disposed across the path of an advancing plurality of sheets. The sheets are advanced along a predetermined path by a friction feeding device, such as intermittently driven feed rollers. The feed rollers ideally should advance only the top sheet while the remaining sheets are held in position by inter-sheet frictional forces. During such ideal performance, the top sheet will abut against the blade. The blade will resist the forward movement of the sheet, but the driving force of the feed roller is greater than the resistance offered by the blade, so that the sheet ultimately passes over the blade and along the predetermined sheet path.

When the sheet feeding operation is less than ideal, the top sheet and one or more lower sheets are advanced, either together or in a staggard formation, toward the restraining blade. As in the case of ideal performance, the top sheet again passes over the blade. However, the lower sheets are inhibited from advancing further. Hence, the top sheet is separated from the other sheet or sheets which abut against the retarding blade. The retarding blade acts on the lower sheets with a force opposite to and greater than the inter-sheet frictional drag. Hence, the top sheet slips over the other sheets and the retarding blade which inhibits the further forward motion of the other sheets.

The effectiveness of the retarding blade is enhanced by providing the blade with a groove juxtaposed to the leading edges of the advancing sheets. The groove is adapted to receive the leading edges and retards the forward advance of all but the top sheet.

It has been discovered that the ability of the retarding blade to minimize multifeeding of sheets can be further improved by increasing the beam strength of the feed sheets and by disposing the retarding blade at an optimum position relative to the leading edge of the advanced sheet. In particular, by imparting an upward curve to a stack of sheets so that the stack assumes a concave shape with respect to the friction feed rollers, the beam strength of the sheets is generally increased along the leading edges of the sheets. The beam strength at any given position may vary from any other position. However, the beam strength is believed to be optimized at a position along the leading edge between the curved end of the stack and a point on the edge in line with the friction feed roller. By disposing the retarding blade at such a position, the increased beamed strength of the concave stack is optimumly used in order to stiffen the upper sheets and thereby prevent the advance of all but the top sheet.

The invention is particularly useful in combination with corner separators and friction roller feeder device in order to provide a two-stage sheet separator. In such an embodiment, the first or initial separation of the top sheet is normally accomplished by the corner separators. If they should fail in their intended purpose, then a pair of retarding blades, forming the second stage of the separator completes the operation. The blades are operatively disposed across the path of the advanced sheets, each between one end of the stack and a point in line with the feed rollers. Such positioning optimizes the use of the increased beam strength provided by the wedges, which concavely shape the stacks. The blades also have a groove for receiving the leading edge of advancing sheet in order to assist in retarding the further advance of all but the top sheet.

DRAWINGS

Figure 3A:
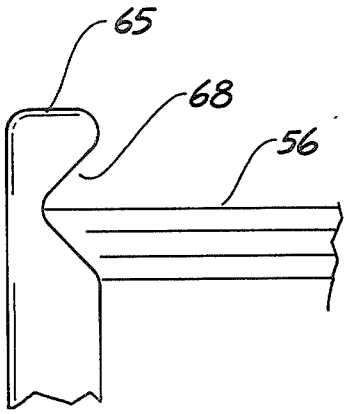

FIG. 3*a, b, c* are a series of schematic illustrations showing an enlarged, partial elevation of a retarding blade and how a top sheet is separated from other sheets by the retarding blade.

Figure 2:
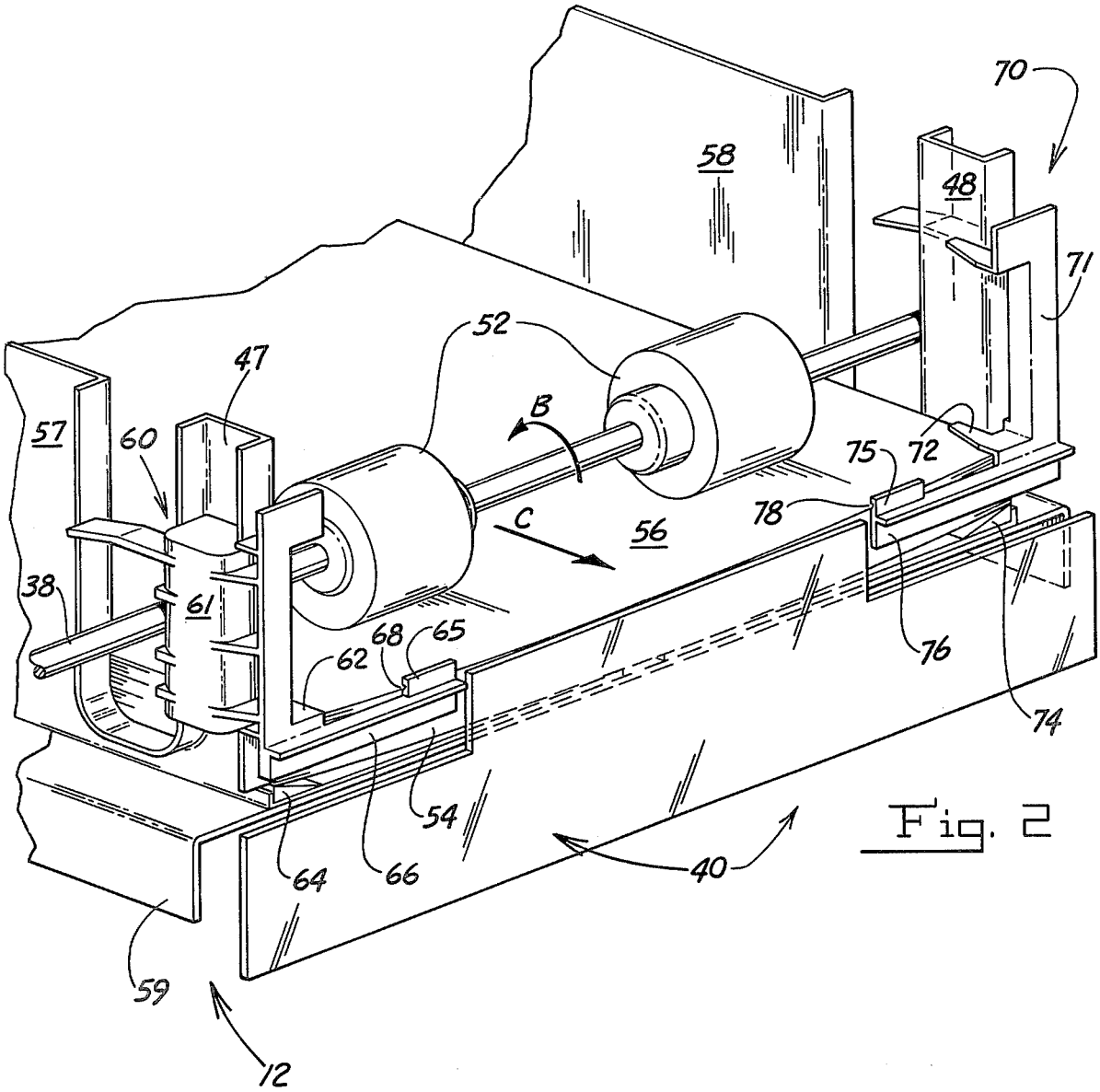
FIG. 2 is a perspective view of a two stage sheet separator loaded with a stack of sheets.
Figure 4:
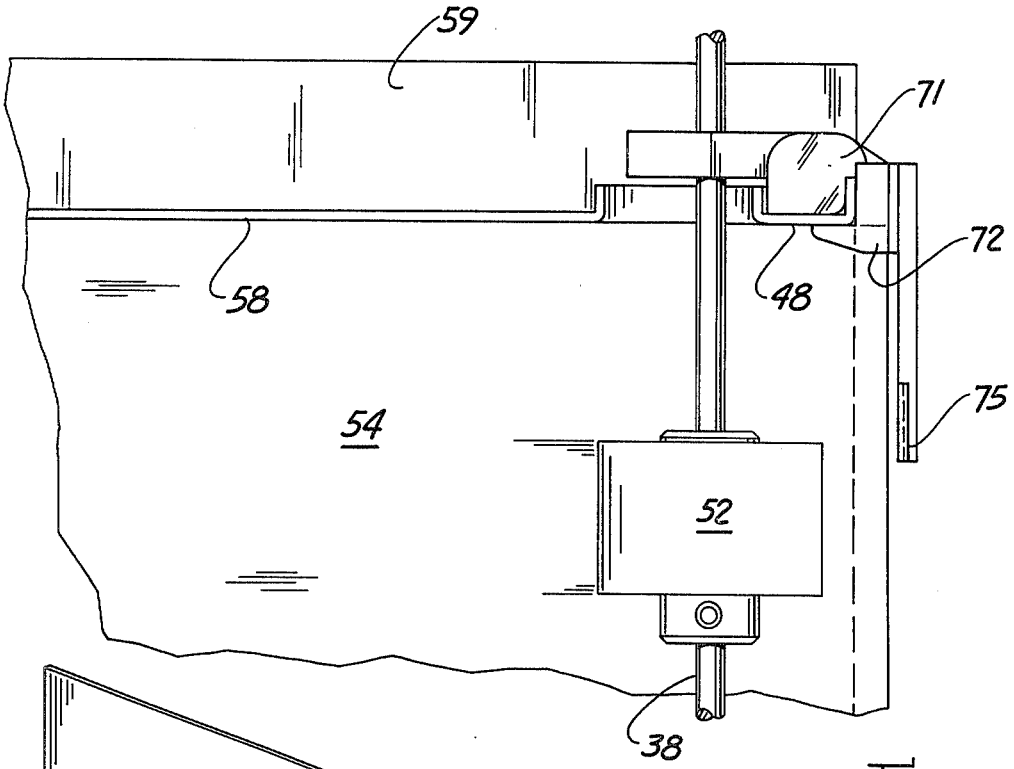

FIG. 4 is a partial top view of the two stage sheet separator of FIG. 2.

Figure 5:
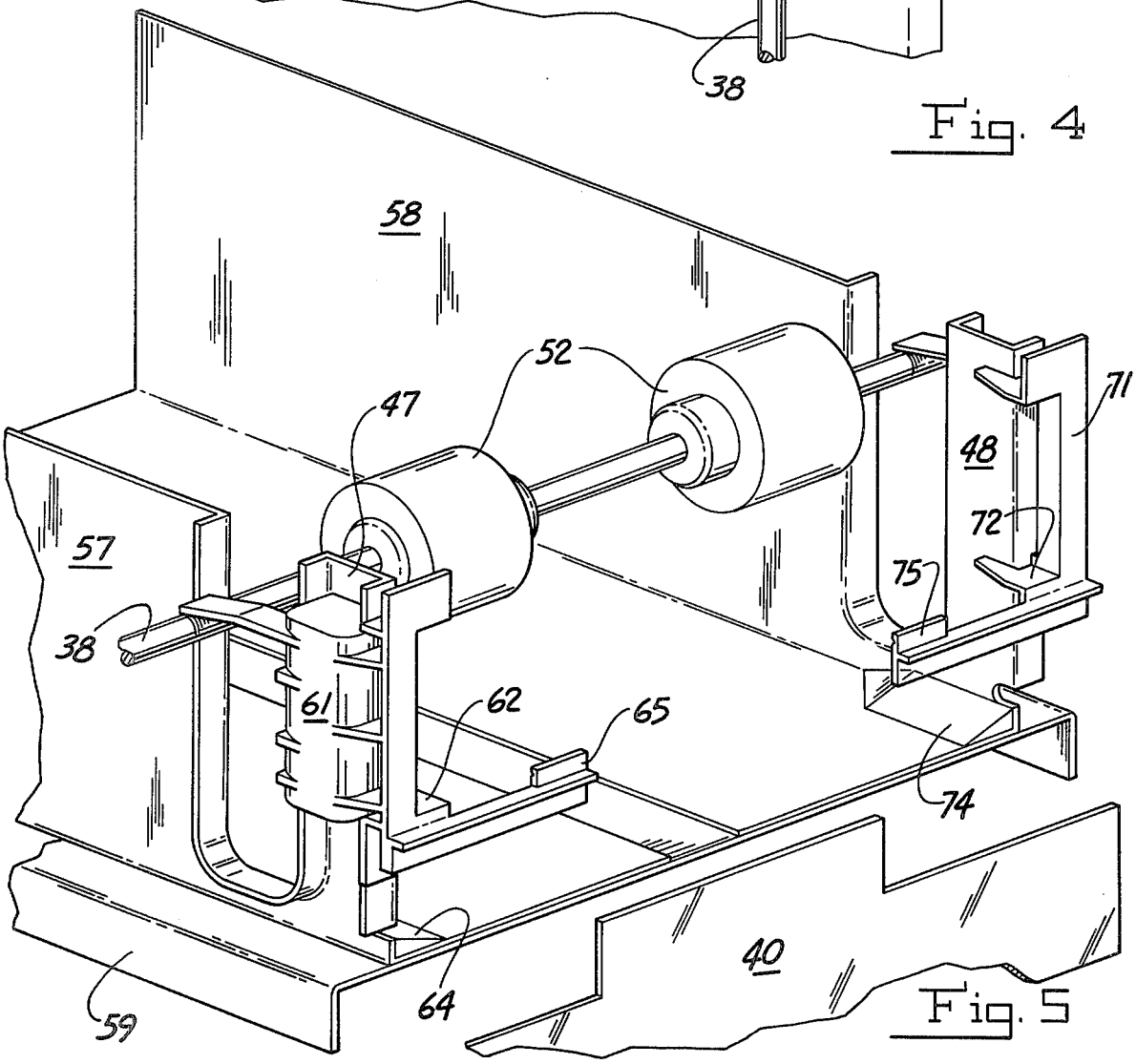

FIG. 5 is a perspective view of an empty two stage sheet separator.

PREFERRED EMBODIMENT

Figure 1:
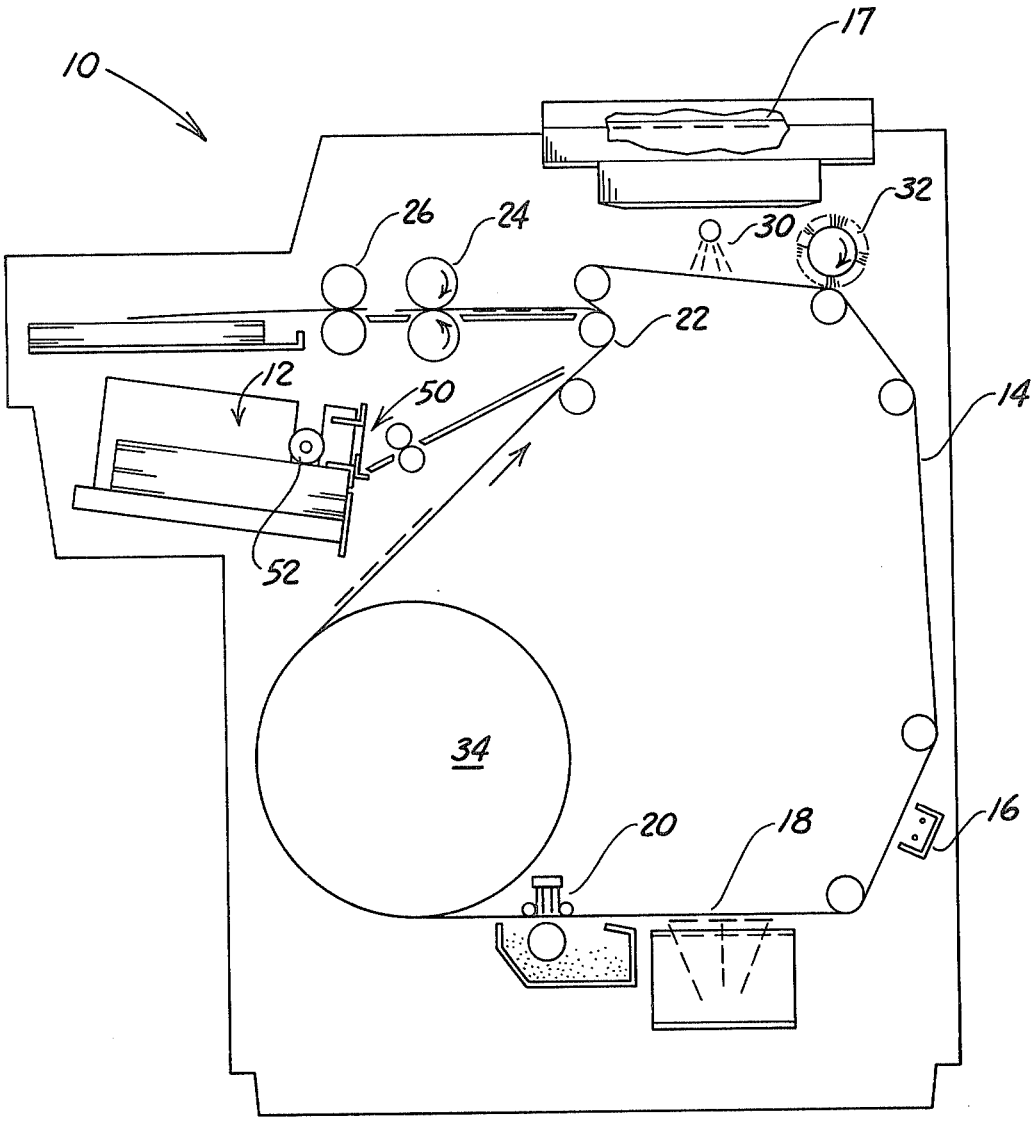
FIG. 1 is an elevation view of the invention in a copier.

Turning to FIG. 1, the preferred embodiment of the invention, generally indicated at 50, is shown in a sheet feeding device 12 of a copier 10 and operates in a manner well known to those skilled in the art. Only so much of the operation of copier 10 will be described herein in order to acquaint the reader with the environment in which the preferred embodiment will be described.

In a typical copying operation, a document to be reproduced is placed face down on a transparent platen 17. A belt-like member having an upper photosensitive layer, such a zinc oxide, is driven around an endless path by drive roller 34 past a number of machine elements. In sequence, the belt 14 passes a corona charging device 16 which imparts a uniform electrostatic charge to the passing zinc oxide layer. Then, it passes an exposure station 18 whereupon the document on the platen is illuminated and optically exposed to the passing belt 14. The light-struck areas of the belt are discharged and the dark areas that correspond to the indicia of the document retain their charge to form a latent electrostatic image of the document. As the belt continues on its path, the latent image passes through a developer 20 where marking material is attracted to the remaining charged areas thereby developing the latent image.

Next, the belt 14 carrying the developed image (as indicated by dashed lines) moves toward a transfer roller 22. In timed relationship with the belt 14, a two stage sheet separating and feeding apparatus 12 is actuated to separate and feed the top sheet of a stack sheet, the separation being performed by the invention 50 in cooperation with intermittently driven feed rollers 52. As the top sheet and the belt 14 pass together over transfer roller 22, the marking material is transferred to the sheet. After passing over the transfer roller 22, the image bearing copy sheet is separated from belt 14 and passes through a fusing device, such as a pair of pressure fixing rollers 24, where the marking material is firmly fixed to the copy sheet. The copy sheet finally passes through a pair of discharge rollers 26 which feed the copy sheet to a receiving tray 28. Meanwhile, the belt 14 is neutralized by erased lamp 30 in order to dissipate any residual charge thereon and any untransferred toner if removed by a soft, rotating brush 32, thereby making belt 14 ready for the next copying operation.

Turning now to FIG. 2, the invention 50 is shown embodied in the two-stage sheet separating and feeding apparatus 12 of the photocopy machine 10. The apparatus 12 has a base 59 for supporting a stack of sheets 54. A pair of intermittently drive, coaxial, spaced apart feed rollers 52 are suitably mounted for frictionally engaging top sheet 56 of stack 54. Side walls 57,58 are disposed one along each opposite side of base 59 for laterally retaining the stack 54. The forward or leading edge of the stacks 54 is placed in registration with a forward wall 40 which is partially cut away at its upper vertical corners in order to accommodate the separator assemblies 60,70. Forward wall 40 is fixedly mounted to a suitable internal frame portion of the copy machine 10. The base 59 and the other three walls form an integral unit that is cantilevered along the rear portion of the base 59 and biased upwardly against feed rollers 52.

In the preferred embodiment the feed rollers 52 are keyed to a common shaft 38 which is intermittently driven by a motor through a clutch (not shown). The paper feeder 12 is biased through any suitable means against feed rollers 52 in order to establish a predetermined normal force acting between the feed rollers 52 and the stack 54. It has been discovered that a normal force of 19 ounces plus or minus 1 ounce works well in combination with a pair of isoprene rubber feed rollers 52, each of which is one inch wide. Those skilled in the art will recognize that there are a number of different combinations of normal forces, roller material and roller widths which will feed the top sheet 56, as will be discussed hereinafter.

Left and right separator assemblies 60,70 are respectively slidably mounted on support columns 47,48, which are each respectively part of side walls 57, 58. The separator assemblies 60, 70 are biased toward the stack 56 by suitable biasing means (not shown). The separator assemblies have vertical retainers 61,71 which are integrally molded with respective corner separators 62,72 and retarding blades 65, 75. The corner separators 62,72 are each finger-like members which overlap the respective left and right hand corners of top sheet 56 of stack 54.

The retarding blades 65,75 are, in the preferred embodiment, each an integral part of the separator assemblies 60,70. The blades 65,75 are mounted on arms 66,76 which extend from the respective assemblies 60,70 across and in front of a portion of the leading edge of stack 54. As shown in FIG. 4, the blades 65,75 are disposed slightly forward of the leading edge of stack 54. As such, the corner separators 62,72 operate on the top sheet before it is advanced to the blades 65,75.

Blade 65 has a groove 68 extending across the side of the blade that faces the stack 54. The groove 68 is formed by two surfaces, one of which is inclined upwardly at an angle of forty-five degrees with respect to the top of stack 54 and another surface inclined downwardly at an angle of forty-five degrees. The corners of the groove are rounded to minimize any hooking of frayed edges of paper on the blade 65. Blade 75 is similarly constructed with a groove 78.

Figure 3B:
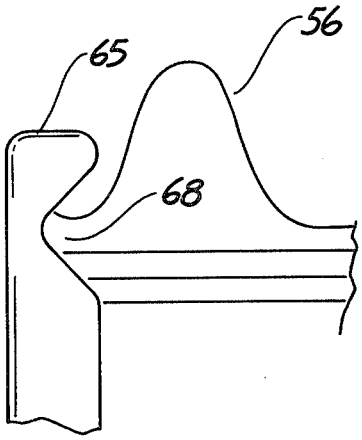
Figure 3C:
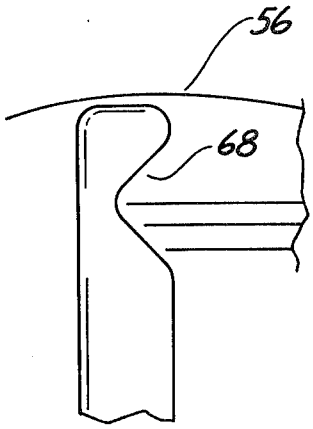

The preferred construction of the groove in each blade is best shown with reference to FIGS. 3*a–c* where typical blade 65 is partially shown.

Turning now to FIG. 5, in particular, to the forward corners of the paper feeder 12, at the junctures of the base 59 and side walls 57,58, there are respectively disposed, one in each corner, two wedges 64,74. Those wedges 64,74 impart a slight concave configuration to the stack 54 with respect to the feed rollers 52. As a result the beam strength of each sheet of the stack 54 is increased, thereby resisting the normal tendency of the sheets to deform and separate under the influence of the corner separators 62,72 and feed rollers 52. It has been discovered that the beam strength increases in accordance with the height of the wedges. For optimal separating and feeding of normal, 8½ inch wide paper, wedges having a height of ⅛" and a base of ½" were found to work best. Experimental results showed a 17-to-1 reduction in multifeeds between a feeder 12 equipped with wedges 64,74 and the blade separators, and feeder 12 without such devices. However, as the height of the wedges was experimentally increased beyond ⅜" their effectiveness was diminished. The corresponding increasing beam strength of the stack 54 was apparently strong enough to overcome the normal friction feeding forces and the rollers 52 ultimately slipped on the top sheet without either separating or feeding the sheet.

In operation, the two stage sheet separating and feeding apparatus performs as follows; At a predetermined time the feed rollers 52 are driven in the direction shown by arrow B for a predetermined interval of time. Under normal operating conditions the top sheet 56 is pushed forward in the direction shown by arrow C. The corner separators 62,72 resist the forward movement of the top sheet 56. Under the influence of the frictional, forward driving force and the resistance of the corner separators 62,72, the top sheet deforms along its leading edge. The deformation increases, the sheet 56 is bowed or buckled upwardly and thus ultimately separated and fed from the stack 54. The leading edge of sheet 56 abuts against the blades 66,76 where it again deforms, and buckles and is driven over the blades by the substantial frictional driving forces of rollers 52.

When the corner separators fail and two or more sheets are separated and advanced from the stack 54, then the second stage separators, namely blades 65,75, perform the final separation which is schematically illustrated in FIGS. 3*a–c*. For illustration purposes, the following discussion will mainly refer to blade 65 and it is understood that what is said applies equally to blade 75. As the top sheet 56 moves toward the blade 65, it is dragging along with it one or more adjacent lower sheets. The adjacent lower sheets are moving under the influence of inter-sheet frictional forces. The leading edge of the sheets abut against blade 65 and are received into the grooves 68, as shown in FIG. 3*a*. Under the influence of the relatively strong friction feeding forces exerted on the top sheet 56 by the feed rollers 52, the leading edge of the top sheet deforms, buckles (FIG. 3*b*), and snaps over the blade (FIG. 3*c*) 65 to advance further along its predetermined path. In contrast, the lower sheets are under the influence of less strong inter-sheet frictional forces. It will be recalled that all the sheets have had their beam strength increased by the wedges 64, 74. Accordingly, the inter-sheet frictional drag on the lower adjacent sheets should not attain a force greater than the retarding force imparted to them by the blades separators as such, the lower sheets are less likely to buckle and snap over the blades 65,75. Of course, the blade 65 provide the main obstacle to the forward movement of the lower adjacent sheets. The resistance of the blades is enough to overcome the inter-sheet frictional forces so that the top sheet 56 slides over the lower sheets, the drag is broken, and only one sheet, top sheet 56, is fed from stack 54.

The foregoing was a description of the preferred embodiment and is not only the manner in which the invention may be used. For example, it has been discovered that the invention can properly separate and feed numerous types of sheet material. It has been successful in feeding plain bond paper of different weights, ranging from the 13 to 24 lbs., label stock, plastic transparencies, and other kinds of variable sheet input material, Although the invention was described in the environment of a photocopy machine 10, it could be used in other types of printing or duplicating machines. Hence, in its broader aspects, the invention is a multipurpose sheet separator.

Those skilled in the art will recognize that there are many combinations of wedge height, roller material, roller width and normal force which could be used. For example, the invention has been successfully tested with half-inch wide rollers. Other roller materials, that have been tested, include standard pink merthane, rough sebian crepe rubber, and orange merthane. The normal force exerted by the rollers can range between eight and nineteen ounces plus or minus one ounce.

Accordingly, the invention described above is not limited to any one particular embodiment but instead is encompassed in the spirit and scope of the following claims.

What is claimed is:

1. A two-stage sheet separating and feeding apparatus for separating and feeding the top sheet from a stack of sheets, comprising:

means for frictionally feeding the top sheet of a stack of sheets along a predetermined path;

a first separator stage including a pair of corner separators, each of said corner separators being operatively associated with one of the two corners of the leading edge of said stack of sheets for separating the top sheet from the stack of sheets; and a second separator stage downstream of said first separator stage for separating the top sheet from any lower sheets which may have been carried along with the top sheet past the first separator stage, said second separator stage including a pair of retarding blades, each of said retarding blades being operatively associated with one of the corner separators and having a transverse groove for receiving the leading edge of a plurality of sheets wherein all but the top sheet is retarded in its forward movement along the predetermined path.

2. The apparatus of claim 1, wherein the groove is formed by two surfaces, one of said surfaces being inclined upwardly at an angle of about 45 degrees and the other of said surfaces being inclined downwardly at an angle of about 45 degrees.

3. The apparatus of claim 2, wherein the groove includes rounded corners.

4. The apparatus of claim 1, additionally comprising means for increasing the beam strength of each sheet in said stack of sheets, whereby the normal tendency of the sheets to deform under the influence of the corner separators and feeding means is resisted.

5. The apparatus of claim 4, wherein the feeding means comprises at least one feed roller.

6. The apparatus of claim 4, wherein each of the corner separators is a finger-like member overlapping its associated corner of the leading edge of said stack of sheets.

7. The apparatus of claim 4, wherein said beam strength increasing means comprises means for elevating a portion of the leading edge of said stack of sheets.

8. The apparatus of claim 7, wherein said elevating means comprises a wedge disposed underneath each corner portion of the leading edge of said track of sheets.

* * * * *